US005591035A

United States Patent [19]

Burkholder et al.

[11] Patent Number: 5,591,035

[45] Date of Patent: Jan. 7, 1997

[54] ELECTRICAL CONNECTOR WITH SHORTENED CONTACT

[75] Inventors: Shawn W. Burkholder, Roanoke, Va.; Gary L. Stonemetz, Mechanicsburg, Pa.

[73] Assignee: The Whitaker Corporation, Wilmington, Del.

[21] Appl. No.: 318,960

[22] Filed: Oct. 6, 1994

[51] Int. Cl.[6] ..... H01R 9/09

[52] U.S. Cl. ..... 439/79; 439/924.1

[58] Field of Search ..... 439/79, 924; 29/826, 29/882, 874

[56] References Cited

U.S. PATENT DOCUMENTS

| | | | |
|---|---|---|---|
| 3,193,791 | 7/1965 | Bock et al. . | |
| 3,569,908 | 3/1971 | Appleton | 439/924.1 |
| 3,701,082 | 10/1972 | Baumanis | 339/61 M |
| 3,818,280 | 6/1974 | Smith et al. | 317/101 DH |
| 4,084,875 | 4/1978 | Yamamoto | 339/94 M |
| 4,200,349 | 4/1980 | Holland | 339/75 MP |
| 4,232,930 | 11/1980 | Teti | 339/186 M |
| 4,343,523 | 8/1982 | Cairns et al. | 339/59 M |
| 4,636,021 | 1/1987 | Bobb et al. | 339/75 MP |
| 4,697,864 | 10/1987 | Hayes et al. | 439/741 |
| 4,842,538 | 6/1989 | Noschese | 439/260 |
| 4,975,085 | 12/1990 | Cartesse et al. | 439/924.01 |
| 4,990,108 | 2/1991 | Sakaguchi | 439/678 |
| 4,996,766 | 3/1991 | Piorunneck et al. | 439/637 |
| 5,067,915 | 11/1991 | Kienast | 439/620 |
| 5,085,601 | 2/1992 | Buchter et al. | 439/660 |
| 5,158,471 | 10/1992 | Fedder et al. | 439/79 |
| 5,173,056 | 12/1992 | Kniese et al. | 439/79 |
| 5,174,787 | 12/1992 | Shirai et al. | 439/489 |
| 5,186,660 | 2/1993 | Wielgos et al. | 439/685 |
| 5,213,514 | 5/1993 | Arai | 439/79 |

*Primary Examiner*—Gary F. Paumen
*Assistant Examiner*—T. C. Patel
*Attorney, Agent, or Firm*—Anton P. Ness

[57] ABSTRACT

An electrical connector (1) having an insulating housing (3), and contacts (7) in the same row being of identical mass in respective contact receiving cavities (8), one of the contact receiving cavities (8) contains one of the contacts (7) that is shortened by a bend (24), and has its front end farther from a mating end (2) of the housing (3) than another of the contacts (7) in another of the contact receiving cavities (8).

16 Claims, 6 Drawing Sheets

ELECTRICAL CONNECTOR WITH SHORTENED CONTACT

FIELD OF THE INVENTION

The invention relates to an electrical connector comprising multiple electrical contacts that are staggered nearer and farther, respectively, from a mating end of the connector.

BACKGROUND OF THE INVENTION

Each of U.S. Pat. Nos., 3,193,791 and 3,818,280 and 4,200,349 and 4,343,523 and 4,636,021 and 4,842,538, discloses a concept of staggering contact surfaces on contact elements of a printed circuit board edge connector in the mating direction of the printed circuit board, thereby to reduce the force needed to mate the circuit board with the connector.

U.S. Pat. No. 5,085,601 discloses a connector comprising, contacts with oppositely bowed contact surfaces to engage opposite sides of contact fins on another mating connector. The contact surfaces are nearer and farther, respectively, from a mating end of the connector to reduce insertion forces during mating with the contact fins.

U.S. Pat. No. 4,084,875 discloses signal and power contacts mixed in one electrical connector, with the signal contacts being spaced farther from a mating end of the connector than the power contacts, to mate with another mating connector after the power contacts have mated with the mating connector.

The connector is constructed with a combination of multiple contact receiving cavities having different spacings from a mating end of the connector. A housing manufactured with one combination of cavities having different spacings from a mating end, is not adaptable to changes in the combination to accommodate different contact spacings. Manufacture of a separate housing is required for each different combination of contact spacings.

The contacts are fabricated with different lengths prior to being assembled in respective cavities of an electrical connector. The contacts of different lengths provide a combination of staggered contacts at different distances from a mating end of the connector. Manufacturing costs are higher to produce contacts that differ from one another in size, as compared with the cost of manufacturing contacts that are identical. Accordingly, an invention can result from an achievement of producing an electrical connector with identical contacts in identical cavities in an electrical connector, and achieving a changeable combination of staggered contacts at different distances from a mating end of the connector.

SUMMARY OF THE INVENTION

According to an aspect of the invention, an electrical connector with identical contacts within each row thereof, and is adapted with a changeable combination of staggered contacts at different distances from a mating end of the connector.

According to another aspect of the invention, an electrical connector is adapted with electrical contacts in respective contact receiving cavities of an insulating housing. At least one of the contacts is farther from a mating end of the housing to mate with another mating connector later than each other contact that is closer to the mating end. The contact that is spaced farther from the mating end will unmate from the mating connector before each closer contact unmates. The contact that is spaced farther from the mating end is identical in mass with the mass of a closer spaced contact of the same row.

According to an embodiment of the invention an insulating housing is constructed with contact receiving cavities that are identical with all others of the same row, such that contacts of identical mass can be interchanged in the cavities of the same row, any one of the contact cavities can contain a contact that is further from a mating end of the housing than the contact in any other contact receiving cavity, and any one of the contact receiving cavities of a row is adapted to receive identical contacts equally spaced from the mating end of the housing.

According to an embodiment of the invention, the contact that is farther from the mating end is initially of identical shape as the contact of identical mass, and is shortened by a bend that is incurred during insertion of the contact into a contact receiving cavity of the housing.

DESCRIPTION OF THE DRAWINGS

An embodiment of the invention will now be described with reference to the drawings, according to which.

DESCRIPTION

Figure 1:
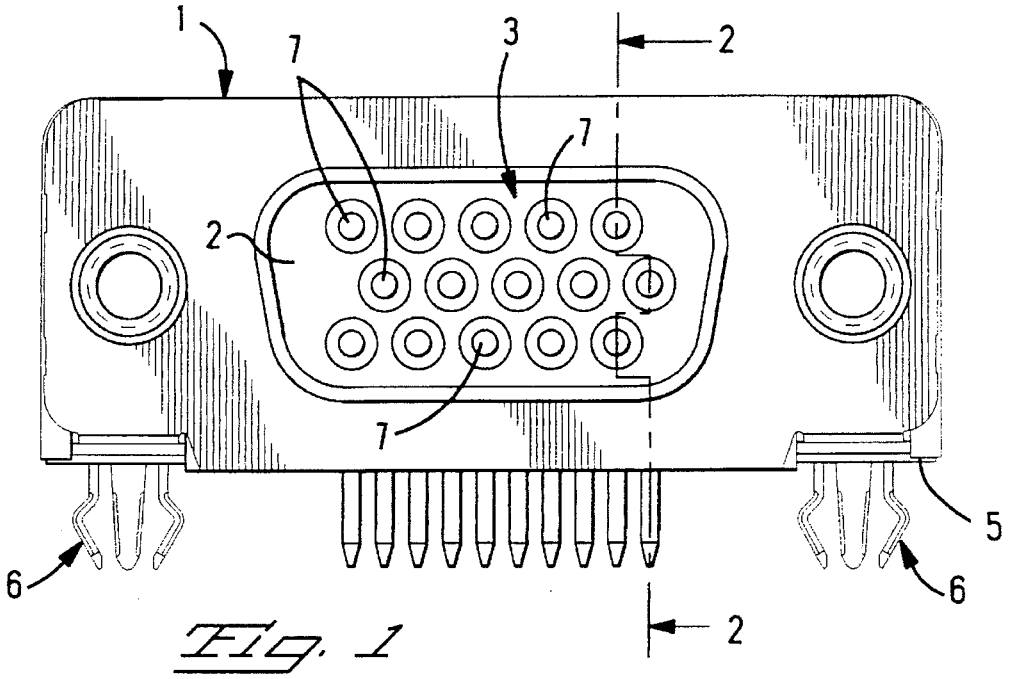
FIG. 1 is a front view of an electrical connector.
Figure 2:
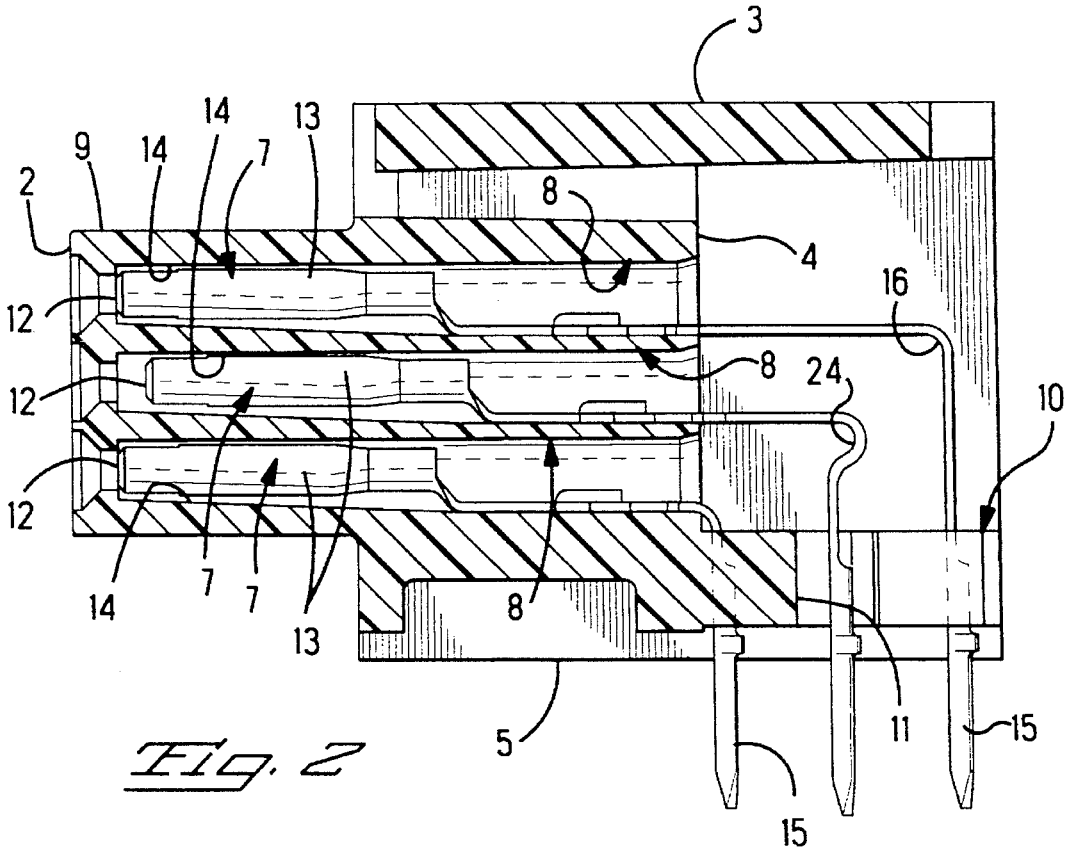
FIG. 2 is a section view of the connector taken along the line 2—2 of FIG. 1.
Figure 3:
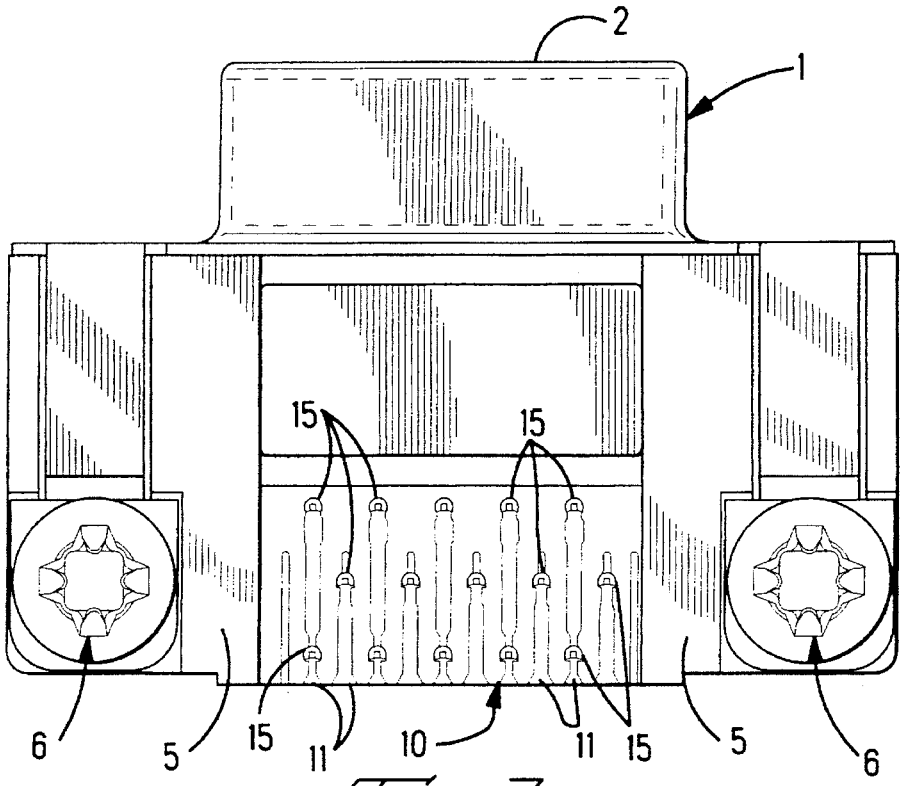
FIG. 3 is a bottom view of the connector shown in FIG. 1.

With reference to FIGS. 1–3, an electrical connector 1 comprises, a front mating end 2 of the connector 1 on an insulating housing 3, a rear end 4 and a base 5 for mounting to a circuit board, not shown. Metal board locks 6 extend beyond the base 5 to plug into openings, not shown, of a circuit board on which the base 5 is mounted. The connector 1 further comprises, electrical contacts 7 in respective contact receiving cavities 8 in a contact receiving front portion 9 of the housing 3, and a plate shaped spacer 10 having respective slotted openings 11 that align the contacts 7.

The contacts 7 and the cavities 8 are arranged in three rows in the housing 3. The contacts 7 along a common row of the contacts 7 are identical in size and shape and mass when manufactured. Thus, when the connector 1 is constructed with one row of contacts 7, the contacts 7 in the one row are manufactured as being identical in size and shape and mass. When the connector 1 is constructed with contacts 7 in multiple rows, the contacts 7 are manufactured identical in size and shape and mass within the same row. The contacts 7 in the same row are interchangeable in respective identical cavities 8 of the same row of cavities.

The contacts 7 are manufactured with a unitary, stamped and formed, metal construction. Front ends 12 on the contacts 7 are on identical mating contact portions 13 that project toward the mating end 2 along identical contact receiving front portions 14 of the cavities 8. Integral terminals 15 on the contacts 7 extend through the openings 11 in the spacer 10 to plug into respective openings, not shown, through a circuit board on which the base 5 is mounted. The contacts 7 extend forwardly in a first direction toward the mating end 2. Each of the contacts 7 projects outward from the rear end 4 of the housing 3, and is bent with ease along their lengths to provide a transverse bend 16 that extends the terminals 15 in a second, transverse direction toward the spacer 10.

Figure 5:
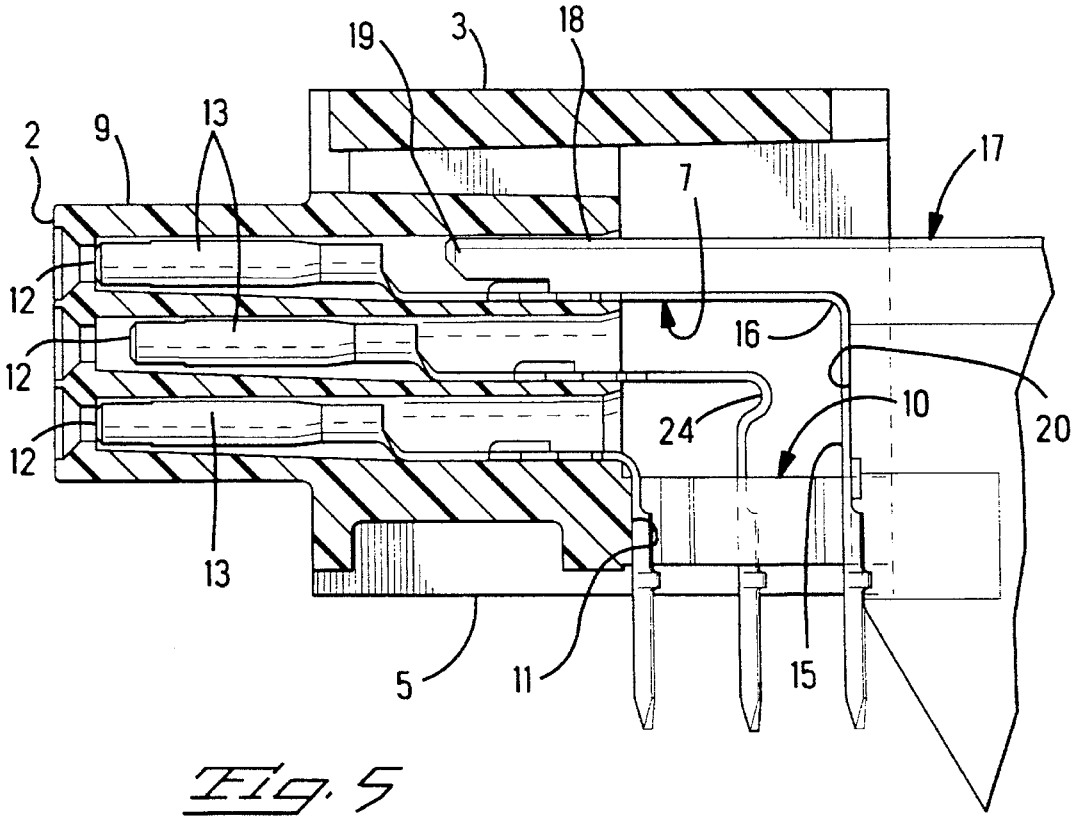
FIG. 5 is a section view similar to FIG. 2, and further illustrating a tool for inserting a contact into a cavity of the connector shown in FIG. 2.

With reference to FIG. 5, insertion of each of the contacts 7 having a transverse bend 16 will now be described. A tool in the form of a contact inserter 17 is provided to correspond with each contact 7 that is to remain identical. Each inserter 17 is a blade that is moved forwardly to insert the contact 7 into a rear of a corresponding cavity 8. The inserter 17 is constructed with a finger 18 that supports the contact 7 along its length. A front 19 of the finger 18 extends into a cavity 8 together with the contact 7 supported against the finger 18, as the inserter 17 and the supported contact 7 are moved forwardly. The finger 18 projects from a transversely extending base 20 that supports the terminal 15 of the contact 7 along its length. The base 20 urges the terminal 15 forwardly into a corresponding slotted opening 11 in the spacer 10. The base 20 enters a slotted opening 11 in the spacer 10 together with the terminal 15, as the inserter 17 and the contact 7 are moved forwardly.

Figure 4:
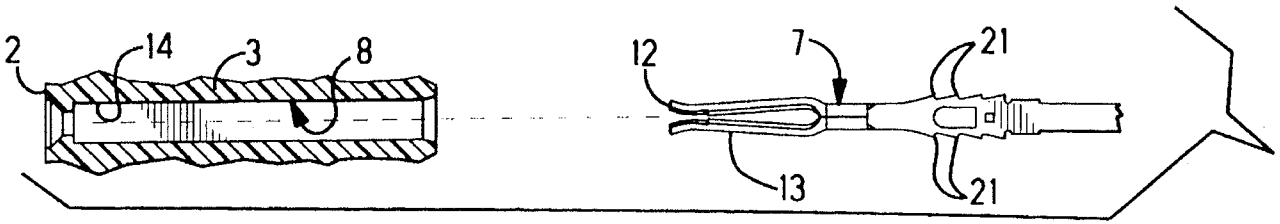
FIG. 4 is a fragmentary section view, taken along 4—4 of FIG. 6, of a portion of a contact receiving cavity of the connector shown in FIG. 1, and a portion of a contact to be received in the cavity.

As shown in FIG. 4, inclined barbs 21 along each of the contacts 7 impinge against an interior of a corresponding cavity 8. As the contact 7 is moved forwardly along the cavity 8 toward the mating end 2, the barbs 21 engage the interior sidewalls of the cavity 8 to retain the contact 7 at its position inside the cavity 8. The barbs 21 provide a resistance force that resist further insertion of the contact 7, which resistance is overcome by a force applied to the contact 7 by the inserter 17, moving forward. If all of the contacts 7 remain identical, the front ends 12 of the contacts 7 will be equally spaced from the mating end 2 of the connector 1, and will be received equally spaced along the contact receiving front portion 9 of the housing 3.

Figure 6:
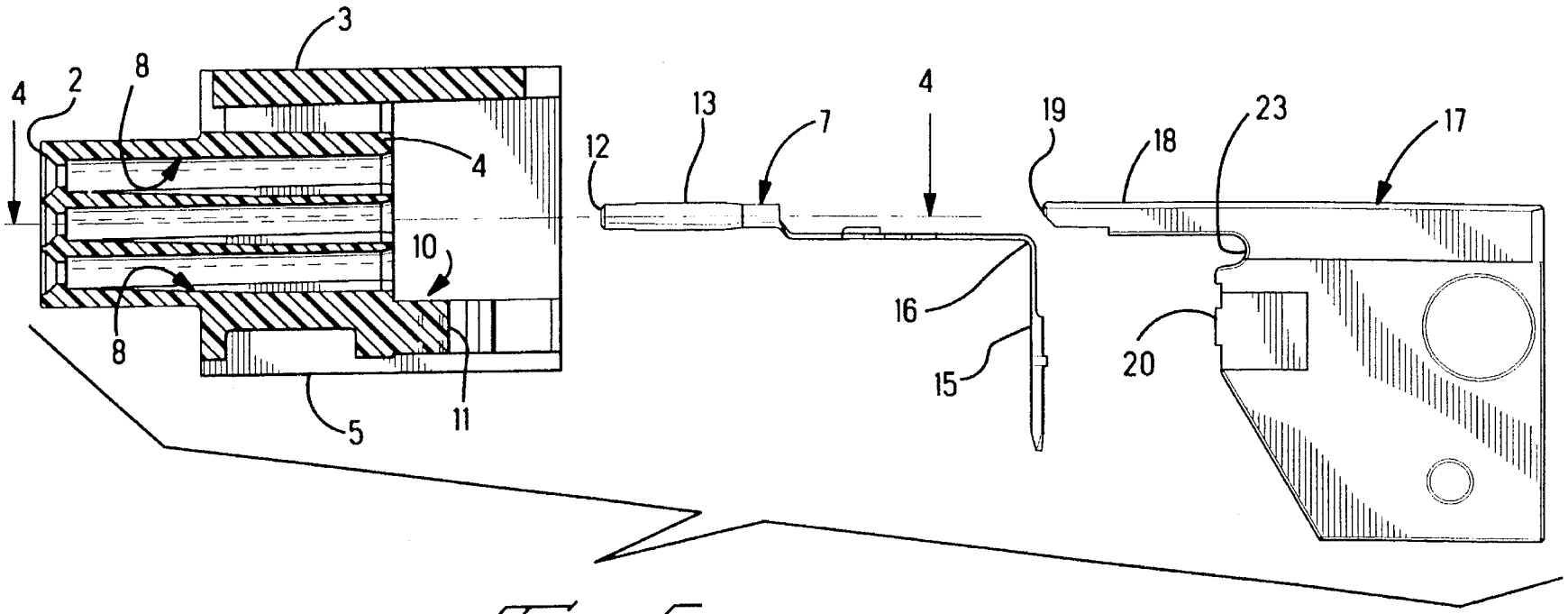
FIG. 6 is a view similar to FIG. 5, illustrating a different tool for inserting a contact into a cavity of the connector shown in FIG. 1.
Figure 7:
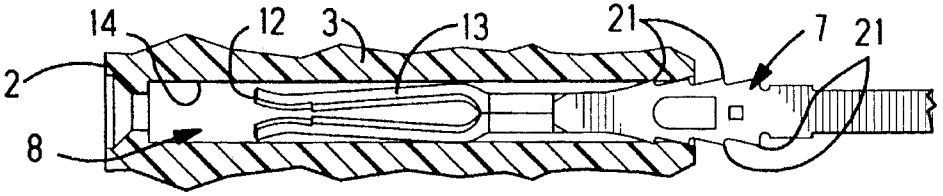
FIG. 7 is a view similar to FIG. 4, illustrating partial insertion of a contact into a cavity of the connector shown in FIG. 1, and is a fragmentary section view taken along the line 7—7 of FIG. 8.
Figure 8:
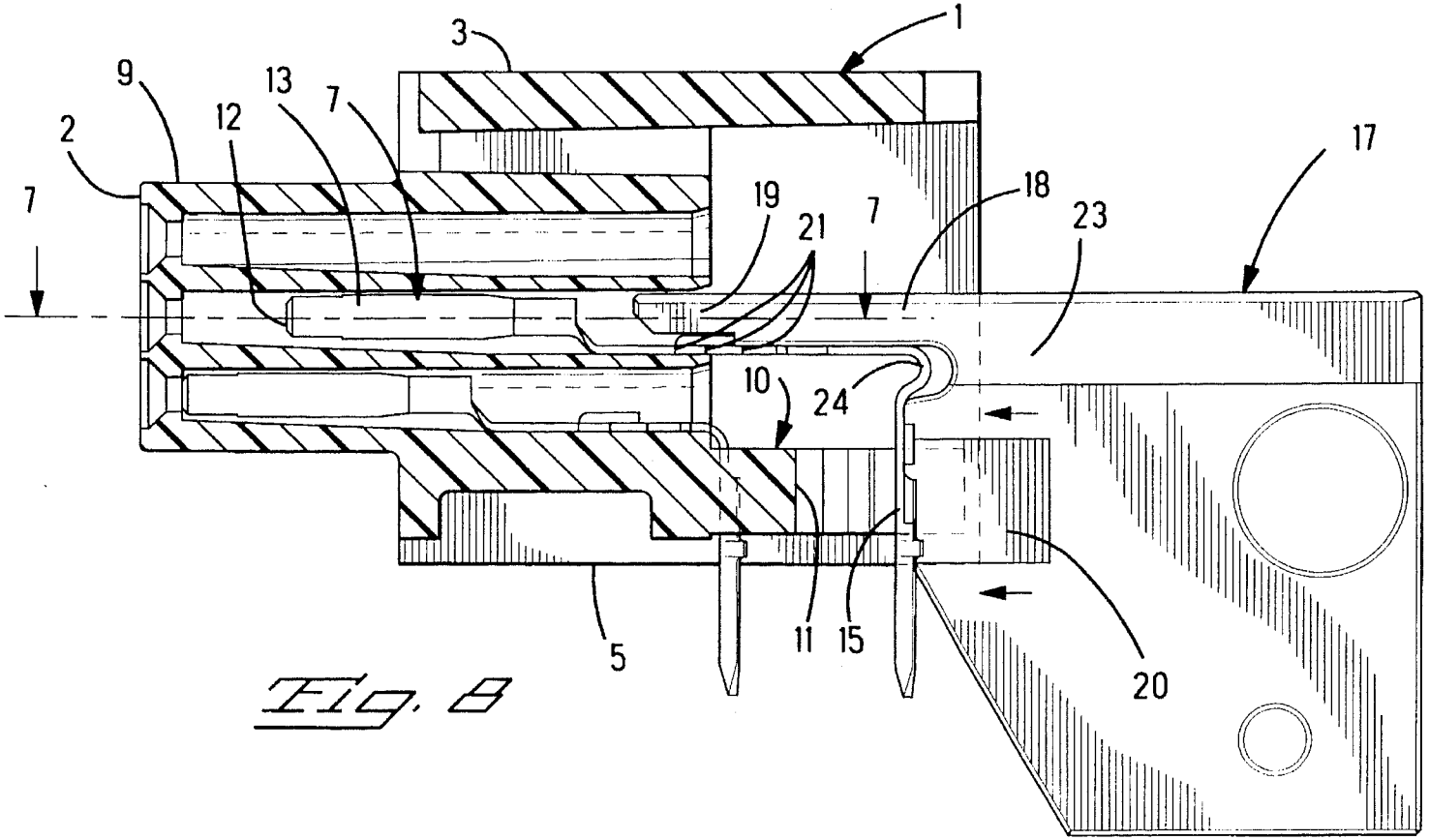
FIG. 8 is view similar to FIG. 5, illustrating partial insertion of a contact into a cavity with the tool shown in FIG. 6.

With reference to FIGS. 2 and 5, an important feature of the invention, resides in at least one of said contacts 7 being shortened along its length by a bend 24 that is not present in at least one other of the contacts of the same row. The bend 24 replaces the transverse bend 16 that was previously present on said one of the contacts 7. With reference to FIG. 6, at least one of the inserters 17 is provided with an arcuate, hook shaped recess 23 at an intersection of the finger 18 and the base 20. The inserter 17 is used to insert said one of the contacts 7 into a corresponding cavity 8. The recess 23 in the inserter 7 is used during formation of the bend 24 in the contact 7 during insertion of the contact 7 into the cavity 8. With reference to FIG. 8, the finger 18 is shown as being inserted part way into a cavity 8, together with a contact 7 being supported by the finger 18 and being inserted part way into the same cavity 8. With reference to FIG. 7, the barbs 21 on the contact 7 engage the interior sidewalls of the cavity 8, and provide a resistance force that tends to resist further insertion of the contact 7 along the cavity 8. As the inserter 17 urges the contact 7 forwardly, with an opposing force larger than the opposing resistance force, the opposing forces cause further bending of the contact 8 at the transverse bend 16 than was present on the contact 7 as manufactured. The contact 7 becomes formed with an arcuate bend 24 that replaces the previously present, transverse bend 16. The arcuate, or further bend 24 is received in the recess 23 in the inserter 17 shortens the length of the contact 7 in the first direction along the cavity 8. Consequently, the length of the contact 7 required to extend along the bend 24 subtracts from the length of the contact 7 in the first direction along the cavity 8. The bend 24 causes a reduction in the length of the contact 7 in the first direction along the cavity 8 thereby causing the front end 12 of the contact 7 to recede from the contact receiving front portion 9 of the housing 3, as compared with the front end 12 of each contact 7 in the same row that is without a corresponding bend 24. Except for the bend 24 in at least one contact 7, in all other respects, the contacts 7 in the same row remain identical in size, shape and mass as when manufactured.

Figure 9:
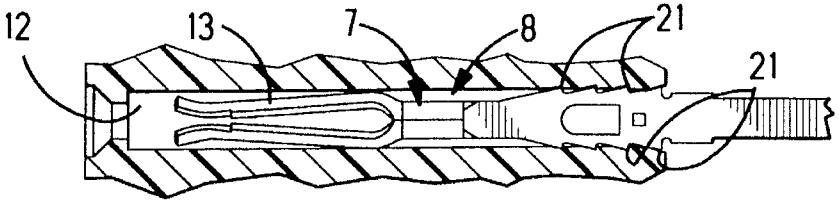
FIG. 9 is view similar to FIG. 7, illustrating a contact inserted by the tool shown in FIG. 6, and is taken along line 9—9 of FIG. 10.
Figure 10:
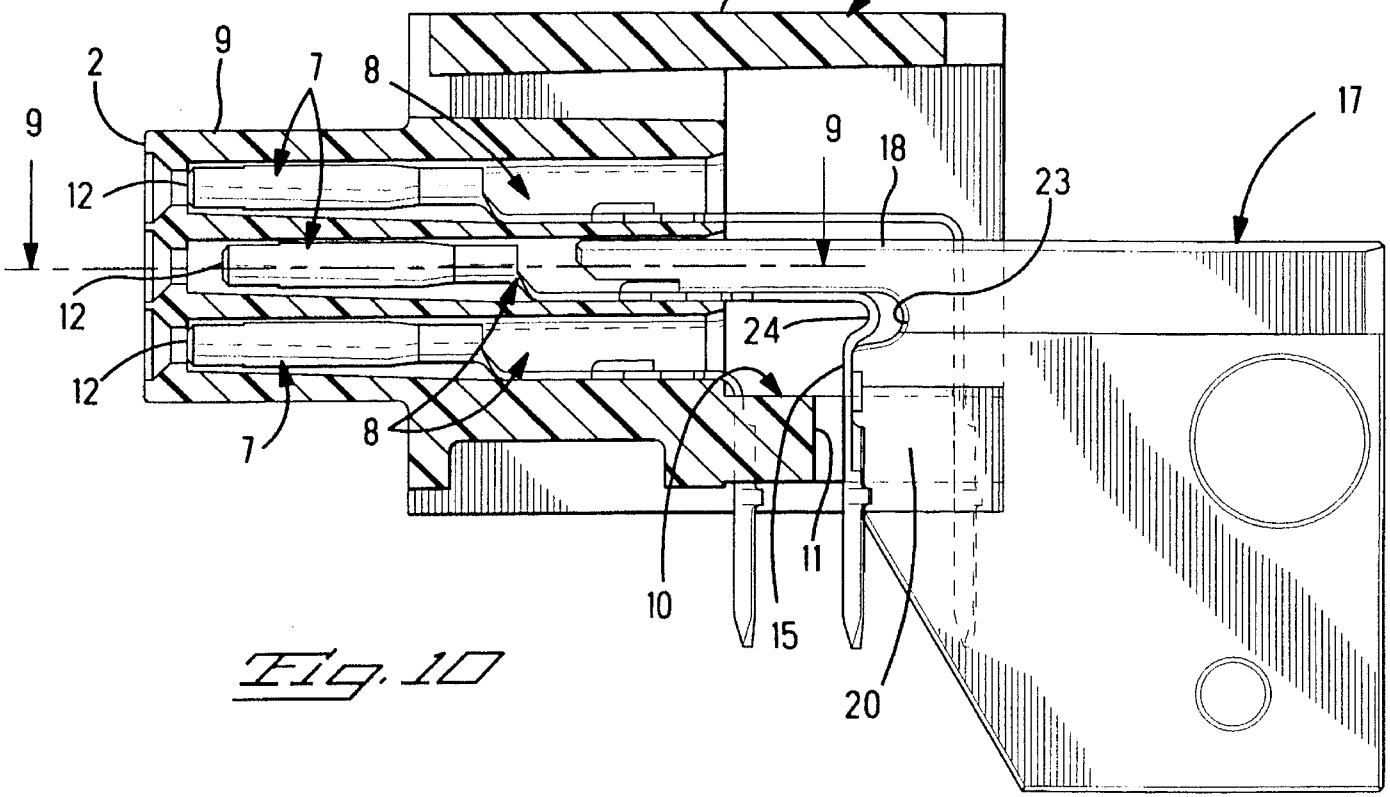
FIG. 10 is a view similar to FIG. 6, illustrating completed insertion of the contact by the tool shown in FIGS. 6 and 8.

Referring now to FIGS. 9 and 10, contact 7 with its bend 24 has now been fully inserted into its cavity 8. Each one of the contacts 7 having a bend 24 is recessed or spaced farther from the mating end 2 of the housing 3 than at least one other contact 7 of identical mass, and each such contact is shorter in length along cavity 8 than is each other contact 7 of identical mass. Recessed contact 7 is identical in shape with each said other contact 7 except for further bend 24 that is not present in each said other contact 7, and that is incurred during insertion of the contact 7 into a contact receiving cavity 8. The contact with bend 24 can be said to be shorter in the distance between the front end and the rear end than the other contacts, since the rear portion has ben translated fully forwardly to its appropriate position aligned with the vertical portions of the other contacts of its row, during formation of bend 24, while the position of its front end remains recessed with respect to the front ends of the other contacts of its row.

Figure 11:
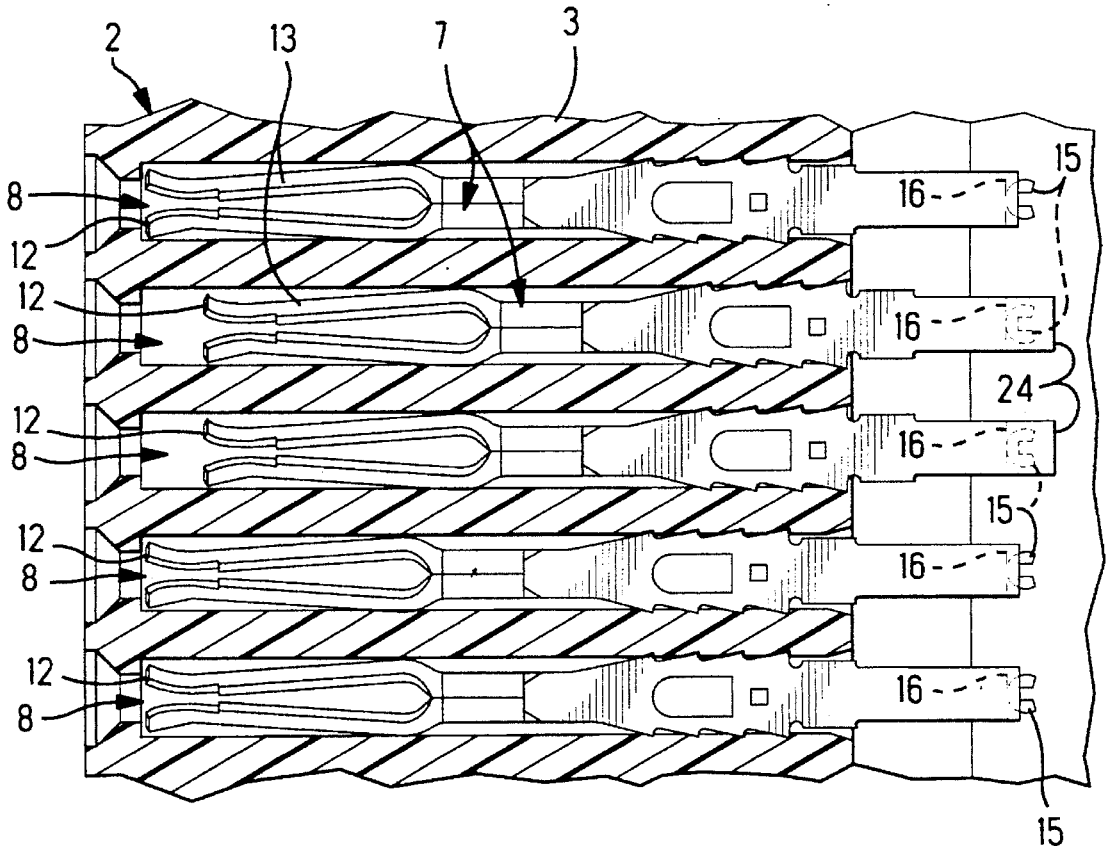
FIG. 11 is a partial cross-section in plan view illustrating a row of contacts with two thereof recessed from the mating face.

FIG. 11 illustrates the row of contacts after insertion into respective passageways, with a representative two thereof having leading ends recessed from the loading ends of the other contacts, and having bends 24; the solder tails of contacts with bends 24 are shown in phantom aligned with the visible solder tails of the fully inserted contacts but which are otherwise being hidden by bends 24.

The contacts 7 in the connector 3 mate with mating contacts, not shown, of another mating electrical connector, not shown, to which the connector 3 is mated, for example, by plugging connection with the mating connector. The recessed contact 7 provides a last to mate, first to unmate contact 7 when the connector is mated, and unmated, respectively, with another mating connector, not shown.

Multiple inserters 17 are used to insert multiple electrical contacts 7 along respective contact receiving cavities 8. Because the cavities 8 are identical, and the contacts 7 where they extend along the cavities 8 are of identical construction, the contacts 7 can be interchanged in the cavities 8. By interchanging the inserters 17 shown in FIGS. 5 and 8, different contacts 7 can be provided with a bend 24.

An advantage of the invention resides in each of the contacts 7 in the housing 3 being adapted with a construction capable of being configured with a bend 24 to shorten said contact 7, and to provide a changeable combination of contacts 7 having said front ends 12 at different distances from said mating end 2 of the connector 1.

Another advantage of the invention resides in said at least one of said contacts 7 being shortened by a bend 24 that is rearward of a front end 12 of the contact 7, and the front end 12 of the contact 7 is recessed from a contact receiving front portion 14 of one of the contact receiving cavities 8.

Other advantages, embodiments and modifications of the invention are intended to be covered by the spirit and scope of the claims.

We claim:

1. An electrical connector comprising:

an insulating housing, and electrical contacts in respective contact receiving cavities in the housing, the contacts of at least a selected row thereof being initially identical in size and shape, the contacts having first portions for being received in interference fit in respective identical contact receiving cavities in the housing associated with said selected row, each of said contact first portions projecting to front ends adjacent a mating end of the connector, and each of said contact first portions in the housing being adapted to be configured with a bend remote from said front end thereof to effectively shorten said contact first portion, and to provide a combination of contacts within said selected row changeable during insertion of said first portions into respective said cavities to effect having said front ends at different distances from said mating end of the connector.

2. An electrical connector as recited in claim 1 wherein each said contact in said selected row includes prior to insertion a right angle bend remote from said front end thereof, and said bend shortening said selected contact is a modification of said right angle bend.

3. An electrical connector comprising:

an insulating housing, contact receiving cavities in the housing, and multiple electrical contacts in respective contact receiving cavities with front ends coextending to proximate a mating end of the housing, said front end of at least one of the contacts being spaced farther from a mating end of the housing than said front end of at least one other contact of identical mass, and said one of the contacts being shorter in length between positions of said front end thereof and a rearward end thereof than that of each said other contact of identical mass.

4. An electrical connector as recited in claim 3, wherein said one contact is shortened by a bend that is not present in each said other contact.

5. An electrical connector as recited in claim 3 wherein, the contact that is spaced farther from the mating end is shortened by a bend that is incurred during insertion of the contact into a contact receiving cavity.

6. An electrical connector as recited in claim 3 wherein, the contact that is spaced farther from the mating end is identical in shape with each said other contact except for being shortened by a bend that is not present in each said other contact.

7. A method of shortening a selected electrical contact, comprising the steps of:

inserting multiple electrical contacts along respective contact receiving cavities in an insulating housing of an electrical connector with a selected contact being inserted farther from a mating end of the housing than each other contact, and shortening a rear portion on the selected contact by a bend that is not present in at least one other contact such that a front end of the selected contact remains recessed rearwardly relative to a front end of said at least one other contact while the rear portion of the selected contact is translated to a selected location.

8. A method as recited in claim 7 comprising the steps of:

forming the multiple contacts identical with one another prior to the step of inserting the multiple contacts along respective contact receiving cavities.

9. A method as recited in claim 7 comprising the steps of:

forming said initially identical contacts to have first portions insertable into respective said cavities in an interference fit;

forming prior to said contact insertion step, right angle bends in all said initially identical contacts and defining contact second portions; and providing a tool for inserting said selected contact wherein said tool includes a relief recess adjacent said right angle bend and aligned with said front end of said selected contact, and said tool further includes a support surface engaging during contact insertion said contact second portion spaced from said right angle bend, whereby, during insertion of said selected contact as said tool engages and supports said contact second portion to urge said contact first portion into said contact receiving cavity, said interference fit urges said right angle bend rearwardly into said tool relief recess such that a front end of said selected contact is spaced rearwardly from front ends of other said initially identical contacts upon full insertion.

10. An electrical connector comprising:

an insulating housing, and contacts of identical mass in respective contact receiving cavities; one of the contact receiving cavities contains one of the contacts that is further from a mating end of the housing than another of the contacts in another of the contact receiving cavities, and the contact receiving cavities being identical and adapted to receive the contacts interchangeably in the cavities.

11. An electrical connector as recited in claim 10, wherein, either one of the contact receiving cavities is adapted to receive identical contacts equally spaced from the mating end of the housing.

12. An electrical connector as recited in claim 10 wherein, the contact that is farther from the mating end is initially of identical shape as the contact of identical mass, and is shortened by a bend.

13. An electrical connector comprising:

multiple electrical contacts in respective contact receiving cavities of an insulating housing, wherein a front end of at least one of the contacts is spaced farther from a mating end of the housing to mate with another mating connector later than a front end of each other contact, and each said at least one of the contacts is identical in mass with the mass of each other contact, and is shorter in length between positions of said front end thereof and a rearward end thereof than said each other contact.

14. An electrical connector as recited in claim 13 wherein, the contact receiving cavities are identical and are adapted to receive the electrical contacts interchangeably in respective cavities to change said combination.

15. An electrical connector as recited in claim 13 wherein, the contacts are identical in shape, except for a bend in at least one contact to shorten said contact.

16. A method of effectively shortening a portion of a contact during insertion into a contact receiving cavity of an electrical connector housing, comprising the steps of:

providing a right angle bend in an electrical contact between first and second portions of said contact, with said first portion of said contact associated with said contact receiving cavity of said housing and insertable thereinto such that a front end of said first portion is positionable at a selected position along said cavity;

providing said first portion of said contact with a shape and dimension to generate an interference fit in said cavity upon insertion thereinto; and providing a tool for inserting said contact including a relief recess adjacent said right angle bend and aligned with said front portion of said contact, and said tool further includes a support surface engaging during contact insertion said contact second portion spaced from said right angle bend, whereby, during insertion of said selected contact as said tool engages and supports said contact second portion to urge said contact first portion into said contact receiving cavity, said interference fit urges said right angle bend rearwardly into said tool relief recess to selectively position said contact front end along said cavity.

* * * * *